US006607106B2

(12) United States Patent
Henry et al.

(10) Patent No.: US 6,607,106 B2
(45) Date of Patent: Aug. 19, 2003

(54) AEROSOL VALVE

(75) Inventors: Thomas Henry, McHenry, IL (US); Jerome Smith, Loudon, NH (US)

(73) Assignee: Conagra Dairy Food Research Center, Downers Grove, IL (US)

( * ) Notice: Subject to any disclaimer, the term of this patent is extended or adjusted under 35 U.S.C. 154(b) by 0 days.

(21) Appl. No.: 09/901,340

(22) Filed: Jul. 9, 2001

(65) Prior Publication Data

US 2003/0006252 A1 Jan. 9, 2003

(51) Int. Cl.[7] ..... B65D 83/16

(52) U.S. Cl. ..... 222/402.1; 222/402.21; 222/402.23

(58) Field of Search ..... 222/402.2, 402.1, 222/402.21, 402.23, 190

(56) References Cited

U.S. PATENT DOCUMENTS

| | | | | | |
|---|---|---|---|---|---|
| 2,660,132 | A | | 11/1953 | Pyenson | 107/14 |
| 2,772,035 | A | | 11/1956 | Collins et al. | 222/394 |
| 2,957,610 | A | | 10/1960 | Michel | 222/394 |
| 3,158,298 | A | | 11/1964 | Briechle | 222/394 |
| 3,333,744 | A | | 8/1967 | Nilsen et al. | 222/402.13 |
| 3,722,760 | A | | 3/1973 | Hug | 222/402.22 |
| 3,758,007 | A | | 9/1973 | Rosen | 222/394 |
| 3,777,947 | A | * | 12/1973 | Klema | 222/402.23 |
| 3,946,906 | A | | 3/1976 | Schwede | 222/135 |
| 3,954,208 | A | | 5/1976 | Brill | 222/402.23 |
| 4,120,431 | A | | 10/1978 | Schultz | 222/518 |
| 4,165,825 | A | | 8/1979 | Hansen | 222/402.22 |
| 4,331,269 | A | | 5/1982 | Holman | 222/402.21 |
| 4,501,409 | A | | 2/1985 | Hill et al. | 251/354 |
| 4,546,905 | A | * | 10/1985 | Nandagiri et al. | 222/189 |
| 4,856,684 | A | | 8/1989 | Gerstung | 222/402.23 |
| 4,867,352 | A | * | 9/1989 | Meshberg | 222/402.16 |
| 4,940,171 | A | * | 7/1990 | Gilroy | 222/402.18 |
| 4,958,755 | A | | 9/1990 | Gerstung | 222/402.23 |
| 5,553,755 | A | | 9/1996 | Bonewald et al. | 222/402.21 |
| 5,730,332 | A | * | 3/1998 | Zimmerhackel | 222/148 |
| 5,785,301 | A | * | 7/1998 | Scheindel | 251/354 |
| 5,848,729 | A | | 12/1998 | Thornton | 222/190 |
| 5,906,046 | A | | 5/1999 | Abplanalp et al. | 29/890.124 |
| 5,915,595 | A | * | 6/1999 | Dow et al. | 222/95 |
| 5,957,342 | A | * | 9/1999 | Galien | 222/402.22 |
| 6,039,306 | A | | 3/2000 | Pericard et al. | 251/353 |
| 6,113,070 | A | | 9/2000 | Holzboog | 251/342 |
| 6,170,717 | B1 | * | 1/2001 | Di Giovanni et al. | 222/402.2 |
| 6,315,173 | B1 | * | 11/2001 | Di Giovanni et al. | 222/402.2 |

* cited by examiner

*Primary Examiner*—Gene Mancene
*Assistant Examiner*—Frederick C Nicolas
(74) *Attorney, Agent, or Firm*—Bingham McCutchen, LLP

(57) ABSTRACT

An improved tilt-type aerosol valve for use with a pressurized whipped cream dispenser. The valve including a radially slotted "fast fill" valve body and further including an actuator with an at least three-pronged flow deflector for minimizing sputtering of the dispensed product.

7 Claims, 3 Drawing Sheets

AEROSOL VALVE

BACKGROUND OF THE INVENTION

The invention is directed to aerosol whipped cream dispensers utilizing tilt valves, wherein the valve is opened by tilting the valve spout. More particularly, the invention is directed towards an improved aerosol tilt valve having "fast fill" characteristics and improved flow characteristics from the valve spout.

Aerosol tilt valves are well known in the art. Generally, a common type of aerosol tilt valve comprises a hollow valve stem that has a valve actuator or spout mounted on top of the stem. The valve stem includes an annular body portion at its base which is disposed within the aerosol container. The valve stem is positioned such that it emerges through a central opening in a pedestal portion of a mounting cup. Underneath the pedestal is a gasket which encircles an orifice in the annular body portion of the hollow valve stem and acts to seal the orifice when the valve is in a closed position. Beneath the gasket and clinched within the pedestal portion of the mounting cup is a valve body. The valve body surrounds the annular base of the valve stem. A spring disposed within the valve body biases the valve stem against the gasket to create a normally closed valve position. Typically, the valve body includes a dip tube which functions to deliver the product/propellent to the interior of the valve. The valve is opened by pushing the actuator laterally, causing the valve stem to tilt and thereby to separate the gasket from the valve stem orifice. A pressurized mixture of product/propellent is then free to exit the valve flowing through the valve body into the orifice in the valve stem and out through the hollow stem. The valve actuator which encloses the stem typically includes an expansion chamber to promote foaming of the dispensed product and may also include a flow deflector to improve foaming, reduce sputtering, and/or direct flow of the product/propellent mixture.

An early example of a tilt valve of the type described above is shown in U.S. Pat. No. 3,158,298 to Briechle, issued in 1964. This patent was directed to a tilt valve suitable for manufacture by high volume production techniques. A more recent example of an aerosol tilt valve is shown in U.S. Pat. No. 5,553,755 to Bonewald et al, issued in 1996. This patent describes certain features which appear to reduce the likelihood of valve stem breakage, a common problem with some earlier designs. Although, past tilt valve designs have proven satisfactory for most uses, there is a desire for improvement in the art. In the case of valves intended for dispensing whipped cream, there is a need for a valve which allows for faster dispensing of the whipped cream product. Further, previous valve actuators for use in dispensing whipped cream have not proven entirely satisfactory in that the actuators tend to produce excessive sputtering of the dispensed product. Sputtering indicates that the propellent gas and whipped cream product are not being efficiently mixed in the actuator. Sputtering causes particles of foamed product to randomly exit the actuator in an uncontrollable manner. Sputtering both wastes product and due to the random exit pattern creates undesirable "mess" placing additional "clean-up" burdens on the consumer. Thus, there is a need for a valve actuator which minimizes sputtering.

SUMMARY OF THE INVENTION

The present invention addresses certain problems of the prior art by providing an improved "fast fill" aerosol tilt valve with an actuator that reduces sputtering. The improved valve includes a valve body having a plurality of radially spaced slots formed in its base. The plurality of slots provide for substantially increased flow area over prior art valves, which typically have only one or two small circular orifices in the valve body and therefore have limited ability to discharge product rapidly from an aerosol container. By contrast, the slotted valve body of the present invention allows for substantially more rapid discharge of the whipped cream product. The present invention aerosol valve may also include a multi-pronged flow deflector. In the exemplary embodiment, a Y-shaped or three-pronged flow deflector is disposed withing the expansion chamber of the valve actuator. The Y-shaped flow deflector provides a substantial, unexpected, decrease in sputtering of the dispensed product when compared to commonly available prior art actuators. In other embodiments, the invention may include flow deflectors, where the number of prongs varies from about three to about six prongs. These and other features of the invention will become more apparent from the following detailed description of the invention, when taken in conjunction with the accompanying exemplary drawings.

DETAILED DESCRIPTION OF THE INVENTION

Figure 1:
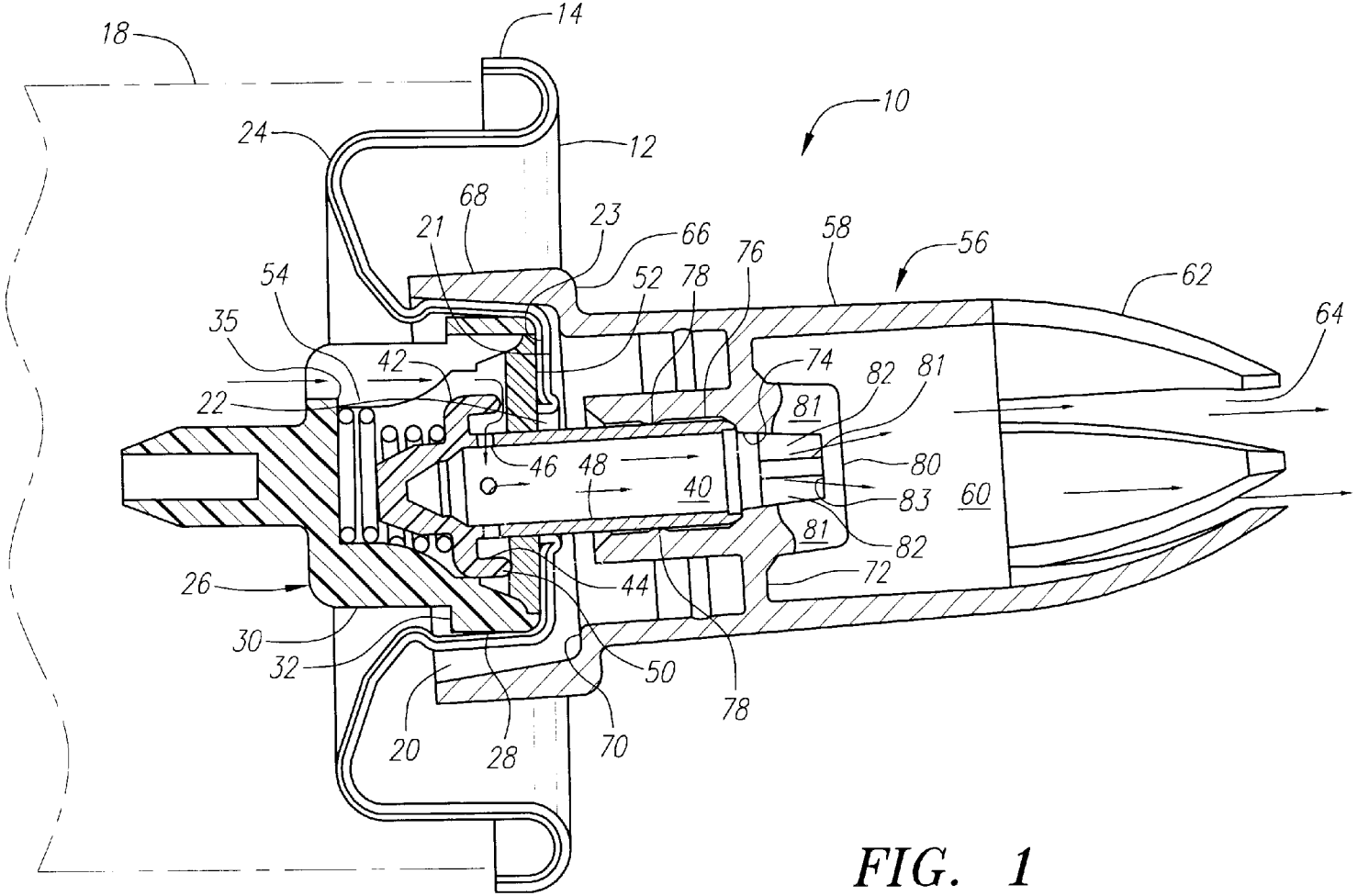
FIG. 1 is a partial cross sectional view, taken along the centerline of the valve assembly showing the tilt-type aerosol valve and the valve actuator of the present invention in the tilted condition or open condition.

Referring now to FIG. 1, the valve assembly 10 comprises generally a mounting cup 12, a valve body 26, a valve stem 40, a sealing gasket 52, a biasing spring 54, and a valve actuator 56. The mounting cup is of generally circular configuration and includes a peripheral lip 14, by which the cup is mounted on top of an aerosol container 18. Centrally formed within the cup is a pedestal 20. The pedestal includes a top 21 having a central stem opening 22. The mounting cup may have a protective sealing laminate 24 on a surface facing the interior of the aerosol container. Preferably, the mounting cup is made of metal.

Figure 2:
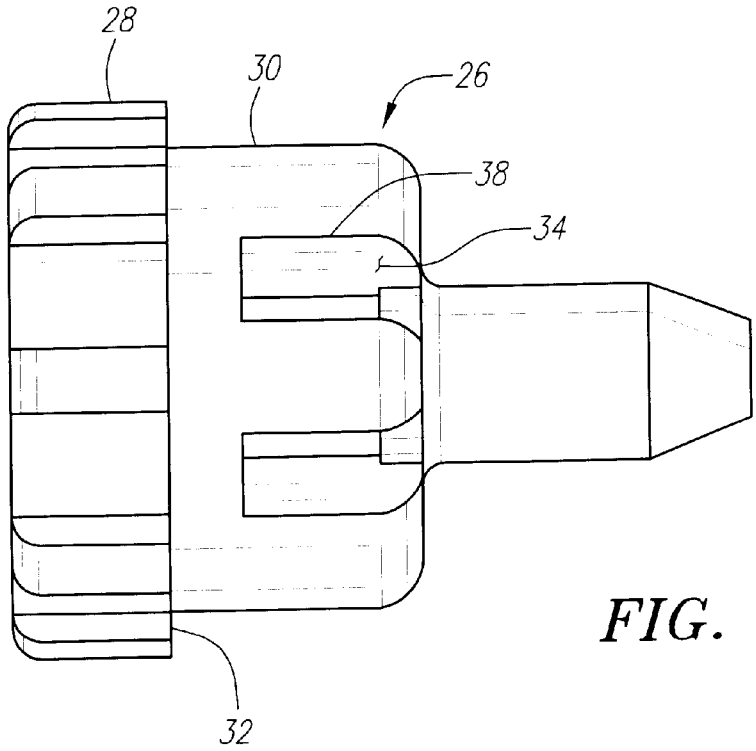
FIG. 2 is side view of a slotted valve body in accordance with the present invention.
Figure 3:
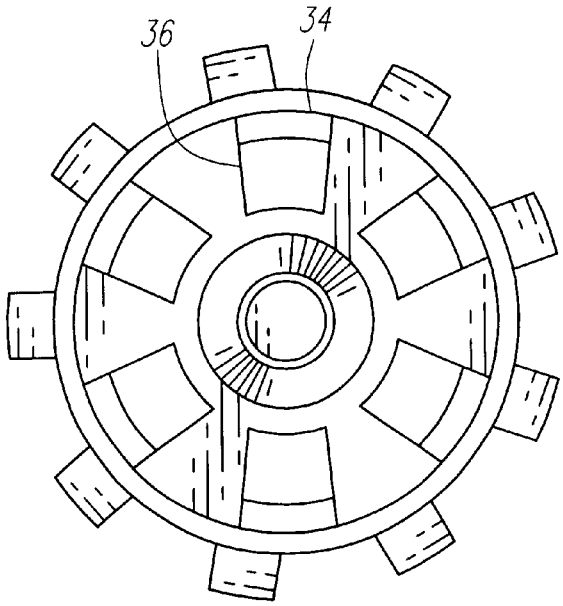
FIG. 3 is bottom view of the slotted valve body show in FIG. 2.

Referring now to FIGS. 1 and 2, the valve assembly 10 also includes a valve body 26. The valve body has an upper portion 28 and lower slotted portion 30. The valve body is securely attached to the mounting cup 12 by crimping the mounting cup along a surface 32 on the valve body formed at the junction of the upper and lower valve body portions. Referring now to FIGS. 2 and 3, the lower valve body portion further includes a plurality of equally spaced slots 34, the slots being of predetermined length 38 and width 36. The slots are disposed inside the aerosol container 18 and provide a large surface area through which the mixture of product/propellent may enter the valve assembly 10. Preferably, the valve body has six equally spaced slots. However, the number of slots may vary from application to application.

Referring again to FIG. 1, the valve assembly also includes a valve stem 40 which comprises a hollow cylindrical stem element 48, and a sealing ring 42, which includes an annular lip 44. The valve stem further includes a plurality of metering orifices 46 which are formed into the stem element adjacent the junction of the stem element and the sealing ring and below an upper edge 50 of the annular lip. Preferably the stem element includes four metering orifices. However, the number and the shape and/or size of the metering orifices may vary depending upon the viscosity of the product to be dispensed from the aerosol can. Preferably, the valve stem and the valve body are formed from an inert, nontoxic, plastic material, such as polypropylene.

As may be seen in FIG. 1, an elastomeric gasket 52 is disposed between an undersurface 23 of the top 21 of the pedestal 20 and the annular lip 44 of the valve stem 40. The gasket, among other functions, serves to close out and seal against fluid leaks; along the open upper portion 28 of the valve body. Disposed through the center of the gasket is the stem element 48 of the valve stem 40. The gasket forms a fluid tight seal around the perimeter of the stem element sufficient to prevent pressurized product/propellant from escaping along the exterior of the valve stem. Disposed between the sealing ring 42 of the valve stem and a base 35 of the valve body is a biasing element 54. The biasing element biases the upper edge 50 of the annular lip 42 of the valve stem upwardly so that the lip makes full peripheral contact against the gasket, thereby sealing off and preventing the product/propellant mixture from escaping from the aerosol container 18, via the metering orifices 46 in the valve stem. Thus, the biasing element functions to keep the tilt valve assembly 10 in a vertically directed or normally closed position. Preferably, the biasing element is a compression spring in the form of a coil wound about an axis coincident with the longitudinal axis of the stem 40.

With continued reference to FIG. 1, the valve assembly 10 further includes an actuator 56. The actuator includes a generally tubular body 58 having an upper or discharge end and a lower or base end. The discharge end of the actuator includes a plurality of peripherally spaced slots 64 defining inwardly curved fingers 62. The inwardly curving fingers form what is generally referred to in the art as a "tulip top." Preferably, the actuator includes five or six equally spaced fingers. At the base end, the actuator is formed with an outwardly extending flange 66 and a downwardly extending skirt 68. The underside of the flange is provided with a downwardly facing annular stop shoulder 70.

The inside of the skirt 68 generally conforms to the shape of the mounting cup pedestal 20. When the actuator is placed over the mounting cup pedestal, the skirt 68 extends downwardly to cover most of the pedestal creating a pleasing aesthetic appearance. Intermediate the upper and lower ends of the actuator is a transverse support partition 72. Extending downwardly from the support partition is a generally centrally aligned nipple 76, which slidably fits over the stem element 48. The nipple and the stem element may be fitted with retaining means such as ribs 78, located on the inside circumference of the nipple and outer circumference of the stem element respectively. When pressed together the rib on the nipple snaps over the rib on the stem element and thereby locks the actuator to the valve stem. Those skilled in the art will understand that various combinations of ribs, or ribs and grooves, or other locking features are possible. Alternatively, a friction fit between the nipple and the stem element, or a friction fit between the skirt 68 and the mounting cup pedestal 20, may also be used.

Figure 4:
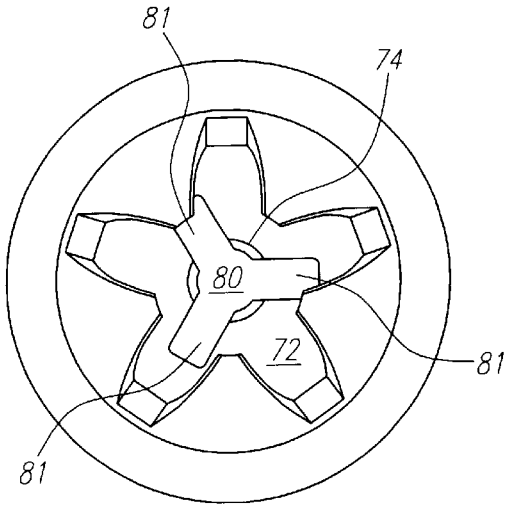
FIG. 4 is a top view of an actuator showing a Y-shaped flow deflector in accordance with the present invention.
Figure 5:
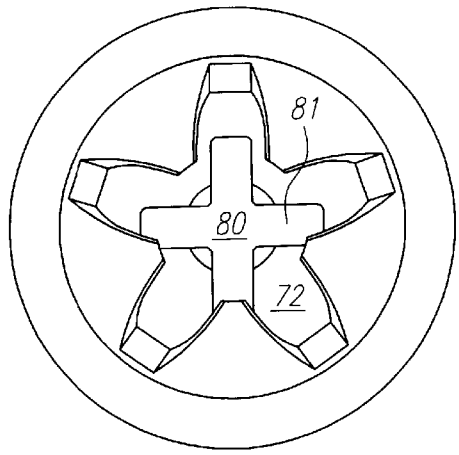
FIG. 5 is a top view of an actuator showing a four-pronged flow deflector in accordance with the present invention.
Figure 6:
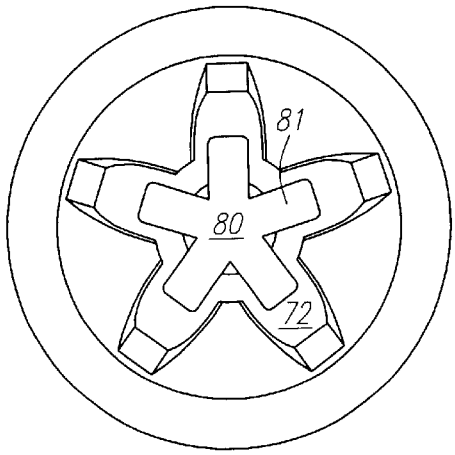
FIG. 6 is a top view of an actuator showing a five-pronged flow deflector in accordance with the present invention.
Figure 7:
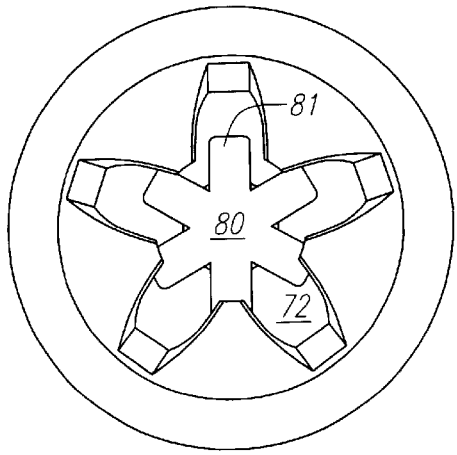
FIG. 7 is a top view of an actuator showing a six-pronged flow deflector in accordance with the present invention.

Referring now to FIGS. 1 and 4, extending upwardly from the transverse support partition 72 is a tapered central passageway 74. Rising above the passage way is a Y-shaped flow deflector 80 (best seen in FIG. 4). Between each leg 81 of the flow deflector is an opening or port 82 (best seen in FIG. 1). It should be noted that the Y-shaped flow deflector has three legs 81 which space an impact surface 83 at a predetermined distance from the central passageway. The Y-shaped flow deflector is aligned generally with passageway 74 and functions to promote mixing of the and foaming of the product/propellant in an expansion chamber 60 which is defined by the interior of the central body portion 58 of the actuator 56. It should be noted that the flow director rises into and is surrounded by the expansion chamber 60. Preferably, the actuator is formed as an integral or unitary part from a flexible non-toxic polymer such as polypropylene or polyethylene. Other materials are suitable and known in the art. Alternative embodiments of the invention may include flow deflectors 80 with more than three prongs. FIGS. 5–7 depict four-pronged, five-pronged, and six-pronged flow deflectors respectively. Each of these flow deflectors will have four, five, or six legs 81 respectively. In some applications, flow deflectors with more than three prongs may prove advantageous.

Operation of an aerosol-type whipped cream dispenser equipped with the improved tilt valve 10 of the present invention is similar to the operation of prior art whipped cream dispensers equipped with tilt valves. First, a user inverts the whipped cream dispenser which causes liquid product in the dispenser to enter the valve body 26 through the radially spaced slots 34. The compressed propellent gas is then located above the liquid product. To dispense the whipped cream, the user applies a lateral force to the actuator 56, typically using an index finger. The lateral force causes the valve stem 40 to tilt, whereby the sealing ring 42 moves downwardly away from the gasket 52 to form a gap between the ring and the gasket. The gap allows liquid product to enter the stem element 48 of the valve stem, via the metering orifices 46. The product passes through the stem element and into the central passageway 74 of the actuator. Upon exiting the central passageway, the liquid product impacts the Y-shaped flow deflector 80 where it is forced out of the ports 82 and into the expansion chamber 60. Mixing of the propellent and liquid product to form a foam begins to occur in the stem element and is substantially complete upon impacting the flow deflector. The flow deflector helps to promote uniform mixing and foaming of the propellent/product. The expansion chamber forms the foamed product into its final dispensed shape. The foamed product subsequently exits the actuator from the tulip shaped discharge end.

It will be appreciated that an improved "fast fill" tilt valve assembly for dispensing whipped cream has been presented. The valve assembly further includes an improved actuator with a flow deflector of at least three prongs which substantially reduces sputtering of the dispensed whipped cream product. While only the presently preferred embodiments have been described in detail, as will be apparent to those skilled in the art, modifications and improvements may be made to the system and method disclosed herein without departing from the scope of the invention. Accordingly, it is not intended that the invention be limited except by the appended claims.

What is claimed is:

1. An aerosol tilt valve for use on a whipped cream dispenser, the tilt valve comprising:

a hollow valve stem having a base, a sealing ring at the base of the valve stem and a plurality of valve stem orifices;

a pedestal having a top, the top including an undersurface and an aperture for receipt of the valve stem;

a gasket having an aperture for receipt of the valve stem, the gasket being disposed between the undersurface of the top and the sealing ring, wherein the valve stem extends through the apertures in the gasket and the top, and further wherein the valve stem orifices are sealed when the sealing ring is in full contact with the gasket;

a valve body having a plurality of slots formed about a periphery thereof, the valve body surrounding the sealing ring and being attached to the pedestal such that the valve body sealingly contacts the gasket, wherein the valve stem and sealing ring may tilt within the valve body upon an application of lateral force to the valve stem, and further wherein the slots are in fluid communication with the hollow valve stem, via the valve stem orifices, when the valve stem is tilted; and a biasing element disposed between the sealing ring and the valve body for biasing the sealing ring against the gasket such that the valve stem orifices are normally sealed in the absence of lateral force applied to the valve stem.

2. The aerosol tilt valve of claim 1, wherein the plurality of slots in the valve body are equally spaced radially about the valve body.

3. The aerosol tilt valve of claim 1, wherein the plurality of slots in the valve body comprises six slots.

4. An actuator for use on an aerosol tilt valve, the actuator comprising a tubular body having a base end and a discharge end, the base end including a downwardly extending skirt, the discharge end including a plurality of fingers forming a tulip shaped top, a support partition formed with a central passageway, the partition being disposed intermediate the ends of the tubular body, a tubular nipple extending downwardly from the central passageway, wherein the nipple may fit snugly about the valve stem of the aerosol tilt valve, and an at least three-pronged flow deflector having a plurality of legs forming a deflection surface and defining fluid ports extending upwardly from the central passageway, the three-pronged flow detector being enclosed by an expansion chamber, wherein the at least three-pronged flow deflector promotes foaming of the aerosol product and reduces sputtering of the product when the product impacts the deflection surface and exits through the fluid ports into the expansion chamber.

5. An aerosol tilt valve assembly for use on a whipped cream dispenser, the tilt valve assembly comprising:

a hollow valve stem having a sealing ring at the base of the valve stem and a plurality of valve stem orifices;

a pedestal having a top and an aperture in the top for receipt of the valve stem;

a gasket disposed between the pedestal and the sealing ring, wherein the valve stem orifice is sealed when the sealing ring is in full contact with the gasket;

a valve body having a plurality of slots about its periphery surrounding the sealing ring and gasketed portion of the valve stem and being attached to the pedestal, wherein the valve stem and sealing ring may tilt within the valve body upon an application of lateral force to the valve stem, and further wherein the slots are in fluid communication with the hollow valve stem, via the valve stem orifices, when the valve stem is tilted;

a biasing element disposed between the sealing ring and the valve body for biasing the sealing ring against the gasket such that the valve stem orifices are normally sealed in the absence of lateral force applied to the valve stem; and an actuator, the actuator comprising a tubular body having a base end and a discharge end, the base end including a downwardly extending skirt, wherein the skirt fits over the pedestal, the discharge end including a plurality of fingers forming a tulip shaped top, a support partition formed with a central passageway, the partition being disposed intermediate the ends of the tubular body, a tubular nipple extending downwardly from the central passageway, wherein the nipple fits snugly about the valve stem, and an at least three-pronged flow deflector having a plurality of legs forming a deflection surface and defining fluid ports extending upwardly from the central passageway and enclosed by an expansion chamber.

6. The aerosol tilt valve of claim 5, wherein the plurality of slots in the valve body are equally spaced radially about the valve body.

7. The aerosol tilt valve of claim 5, wherein the plurality of slots in the valve body comprises six slots.

* * * * *